United States Patent [19]

Figov et al.

[11] 4,188,880

[45] Feb. 19, 1980

[54] BLANK FOR CONVERSION INTO A PERFORATED STENCIL BY SPARK EROSION

[75] Inventors: Murray Figov, Ilford; Iain E. Whitlam, Orpington, both of England

[73] Assignee: Vickers Limited, London, England

[21] Appl. No.: 5,813

[22] Filed: Jan. 23, 1979

[30] Foreign Application Priority Data

Jan. 25, 1978 [GB] United Kingdom ..... 3064/78

[51] Int. Cl.[2] ..... B05C 17/06

[52] U.S. Cl. ..... 101/128.21; 346/135.1; 346/163

[58] Field of Search ..... 101/128.2, 128.4; 427/143; 346/135, 163

[56] References Cited

U.S. PATENT DOCUMENTS

| | | | |
|---|---|---|---|
| 2,664,043 | 12/1953 | Dalton | 101/128.2 |
| 3,113,511 | 12/1963 | Dalton | 101/149.2 |
| 3,376,810 | 4/1968 | Blake et al. | 101/128.2 |
| 3,593,660 | 7/1971 | Kineri et al. | 101/128.2 |

FOREIGN PATENT DOCUMENTS

| | | | |
|---|---|---|---|
| 1187503 | 4/1970 | United Kingdom | 427/143 |

*Primary Examiner*—Evan K. Lawrence

*Attorney, Agent, or Firm*—Shoemaker and Mattare, Ltd.

[57] ABSTRACT

A blank and method for using the same wherein the blank for conversion to a stencil by spark erosion through a stencil layer to a conductive face is arranged so that the layer and face do not have to be peeled apart and chemical and physical interaction between them is avoided, by bonding them only close to one edge of the blank. To prevent shrinkage of the layer to be perforated, a supporting backing is attached thereto to be peeled away before perforation. The conductive face on a backing sheet can be detached along a perforated line close to said edge. A spine that remains attached to the perforated layer facilitates mounting the stencil in a machine.

8 Claims, 2 Drawing Figures

BLANK FOR CONVERSION INTO A PERFORATED STENCIL BY SPARK EROSION

BACKGROUND OF THE INVENTION

This invention relates to a blank for conversion into a perforated stencil by spark erosion and the method of using the blank.

Stencil blanks for use in a spark erosion, stencil cutting machine are well known and commercially available. Such blanks are known which comprise a stout backing sheet or substrate on which is adhered an electro-responsive layer or layers made up of an electrically conductive region adjacent the backing sheet and an electrically resistive region on the conductive region. The backing sheet prevents shrinkage of the electro-responsive layer(s) between manufacture and use of the blank. The blank is converted into a stencil in a stencil cutting machine in which a stylus applied potential causes a current to flow through the resistive region to the conductive region. This current produces localised perforation of the electro-responsive layer(s) to form a stencil. The backing sheet is then peeled from the stencil which is placed in a stencil copier. If attempts are made to copy large black or grey areas of an original, the perforation density (i.e. the ratio of the sum of the areas of the perforations in a given area of the stencil to that given area) on the corresponding part of the stencil will be high. Thus, under such circumstances, peeling of the backing sheet from the stencil is a delicate operation, in order to ensure that the stencil is not torn in areas of high perforation density. Another disadvantage of such known stencils is that when providing the electrically resistive region on the conductive region during manufacture of the blank, chemical or physical interaction between the two layers may take place such as to affect the required properties of these regions.

SUMMARY OF THE INVENTION

The present invention aims to provide a blank and method for using the same wherein the blank is designed for conversion into a perforated stencil by spark erosion, which is improved in the above respects.

According to the invention there is provided a blank for conversion into a perforated stencil by spark erosion, comprising a first sheet, of which one face comprises electrically conductive material, and a second sheet, these sheets being attached together along or adjacent to an edge portion of the blank so that, while otherwise separable from one another, they can lie face-to-face with the second sheet against the electrically conductive face of said first sheet, said second sheet comprising a layer of material to be perforated by spark erosion having a supporting backing on one of the faces thereof to be peeled away from the layer prior to the perforation of the layer.

Conveniently, the peelable supporting backing is provided on that face of the said layer which is remote from the electrically conductive face of said first sheet.

The first sheet, in one construction of the blank, comprises a layer of electrically conductive material on a backing sheet.

BRIEF DESCRIPTION OF THE DRAWING

For a better understanding of the invention and to show how the same may be carried into effect, reference will now be made, by way of example, to the accompanying drawings, in which.

DESCRIPTION OF THE PREFERRED EMBODIMENTS

Figure 2:
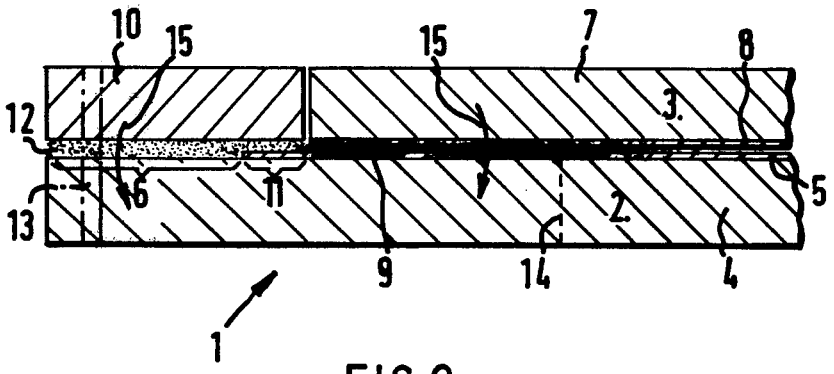
FIG. 2 shows on a greatly enlarged scale a part sectional view of the stencil taken along a vertical section plane passing through the line II—II of FIG. 1.

Referring to the drawings, a blank 1 for conversion into a perforated stencil by spark erosion comprises essentially two sheets, 2 and 3, secured together adjacent to (or along) an edge portion of the blank. The sheet 2, as best shown in FIG. 2, includes a stout backing sheet 4, for example consisting of paper, which is provided on its upper surface with a layer of electrically conductive material 5 which covers the whole upper surface apart from a small edge portion 6 of the backing sheet. The sheet 3 comprises a supporting backing 7, again consisting of paper for example, the entire lower surface of which is covered by a layer of material 8 to be perforated by spark erosion. The backing 7 serves to prevent shrinkage of the material 8 which would occur between manufacture and use of the stencil blank if the layer 8 were permitted to be free without any supporting backing. Suitable materials for use as the layers 5 and 8 and the various ways (such as by coating) in which these layers can be provided on the backing sheet 4 and supporting backing 7, respectively, are known in the art. However, details of one preferred form of blank are given below. The sheet 3 is attached to the sheet 2 so that the layers 5 and 8 can lie face-to-face against one another. A narrow strip of any suitable bonding agent 9 is used for this purpose. To reinforce the projecting edge portion 6 of the backing sheet 4 and also a narrow exposed margin 11 of the layer 5, a strip of material 10, for example the same as that of the supporting backing 7, is butted up against the edge of the backing 7 and adhesively secured to the edge portion 6 and margin 11 by suitable bonding agent 12. This method of reinforcement is well known to those skilled in the art of producing stencils for duplicating and provides a sound means of securing the stencil to the duplicator.

As a typical example of the stencil, the sheet 2 as shown in FIG. 2 may be prepared by coating a paper 4, such as Clan Keith Opaque 85 gsm paper supplied by Inveresk with a layer 5 of electrically conductive material which may comprise a conductive carbon black or mixture of carbon blacks with a suitable binder and plasticizer. Preferably this coating from which the layer 5 is formed is prepared according to the following formulation:

| | |
|---|---|
| DHM grade of Nitrocellulose (from ICI) | 100 parts by weight |
| Acetylene Black Carbon (from Shawinigan) | 200 parts by weight |
| Dibutyl Phthalate | 100 parts by weight |
| Butanone | 200 parts by weight |

The above ingredients are ball-milled together until the carbon is dispersed to a reading on a Hegman gauge of 8, bar coated, and the solvent evaporated by heating to leave a solid layer of 18 gsm.

The sheet 3 comprises a highly calendered paper such as that supplied by Wiggins Teape as M4/24 at 102 gsm. This is covered by a layer of material 8 preferably of the following formulation:

| | |
|---|---|
| Polyvinyl chloride homopolymer (B.P. Corvic D65/02) | 100 parts by weight |
| Regal 315F Carbon Black (from Cabot Carbon Co.) | 38 parts by weight |
| Di-2-ethyl hexyl phthalate | 27 parts by weight |
| Tetrahydrofuran | 1000 parts by weight |

These ingredients are ball-milled together until the carbon is dispersed to a Hegman reading of 8, coated and heated to remove the solvent. The dry film weight 20 gsm.

The sheet 3 is then attached to sheet 2 as described above.

Figure 1:
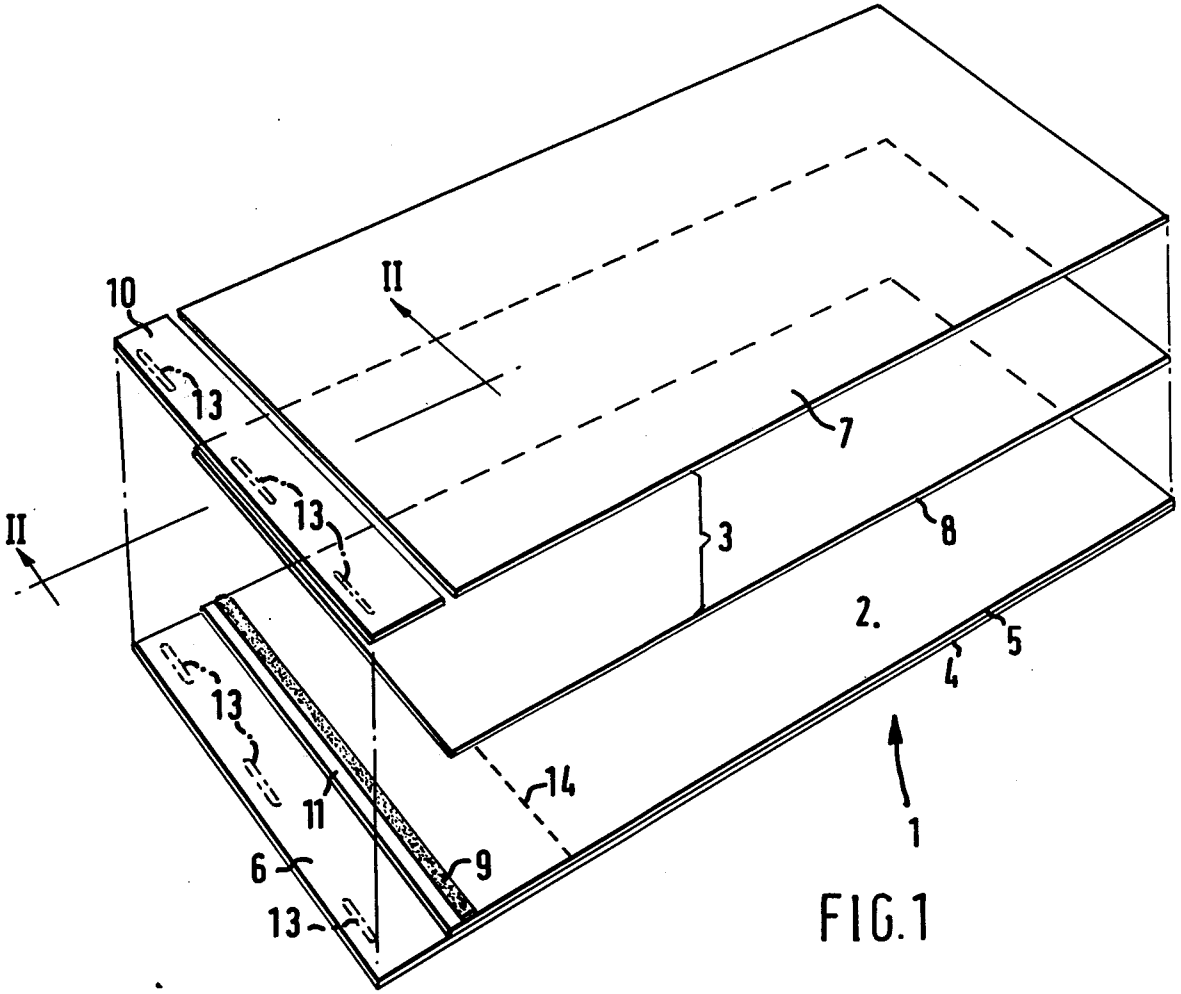
FIG. 1 is an exploded, perspective view of one form of blank for conversion into a perforated stencil by spark erosion.

The described blank is intended to be used in the following way: Firstly, the supporting backing 7 is peeled from the layer 8 of material to be perforated by spark erosion. To assist in separating an edge portion of the backing from the layer 8 to facilitate peeling, the blank can be flexed in the manner indicated by the arrows 15 (FIG. 2). After peeling, the blank is positioned in a stencil cutting machine. After the spark erosion cutting of the layer 8 has been completed, the resulting stencil consisting of the perforated layer 8 is then ready for use in a duplicating machine. The spine of the blank, comprising the strip 10 and underlying portion of the backing sheet 4, may be formed with slots 13 to assist in locating the stencil in the stencil duplicator (see FIG. 1). Prior to such use, the backing sheet 4 with its layer 5 will generally be required to be detached and for this purpose the backing sheet 4 can conveniently be perforated along the line 14 to enable the backing sheet and conductive layer to be torn from the spine.

Various modifications to the blank as described above are possible. For example, the supporting backing could be provided between the layer of material to be perforated by spark erosion and the electrically conductive layer although this would make peeling of the supporting backing prior to stencil cutting more difficult. Another modification is to provide between the supporting backing and the material to be perforated a masking coating which is preferably of whitish colour and which remains united with the underlying layer when the supporting backing is peeled away. The purpose of the masking coating is to enable progress of the spark erosion cutting of the blank to be observed more readily.

It will be appreciated that the described blank and modifications are improved over the previously known stencil blanks described in the introductory part of the specification. Firstly, the backing sheet with its layer of electrically conductive material does not have to be peeled from the stencil after the spark erosion cutting step so there is no risk of damaging the stencil even in areas where the perforation density is high. On the other hand, the layer to be perforated is supported in its backing until just prior to the stencil cutting operation and so there is no risk of the layer shrinking between manufacture of the blank and the stencil cutting operation. In addition, during manufacture, no chemical or physical interaction can take place between the material of the layer to be perforated and that of the conductive layer since these layers are applied separately to their different backings.

We claim:

1. A stencil blank comprising a first sheet, a second sheet, said sheets being located face to face and substantially coextensive with one another, means securing an edge portion at one end of said first sheet to an adjacent edge portion at one end of said second sheet, said sheets being separable from one another over all areas thereof remote from said edge portions, said first sheet including a layer of electrically conductive material substantially extending over one face of said first sheet and located against said second sheet, and said second sheet comprising a layer of material capable of being perforated by spark erosion to form a stencil and said second sheet further comprising a supporting backing peelably attached over one face of said layer to be perforated for preventing shrinkage thereof prior to perforation, whereby said supporting backing can be peeled away to expose said layer to be perforated, whereby said last mentioned layer can be perforated by spark discharge therethrough to said layer of electrically conductive material to form a perforated stencil.

2. A blank according to claim 1, in which said supporting backing is peelably attached over that face of said layer to be perforated which is remote from said electrically conductive layer.

3. A blank according to claim 1, in which said securing means is a narrow strip of a bonding agent interposed between said first and second sheets.

4. A blank according to claim 1, in which said first sheet is formed adjacent and parallel to said edge portion thereof with a line of weakness enabling said first sheet to be torn apart subsequently to the perforation of said layer to be perforated, leaving only said edge portion of said first sheet attached to said perforated layer.

5. A blank according to claim 1, in which said edge portion of said first sheet overlaps said edge portion of said second sheet thereby exposing an edge piece of said first sheet beyond said edge portion of said second sheet, the blank further including a strip of reinforcing material bonded to said edge piece parallel and adjacent to said edge portion of said second sheet.

6. A blank according to claim 5, in which said layer of electrically conductive material extends only over a part of said edge piece projecting from said edge portion of said second sheet.

7. A blank according to claim 1, in which said first sheet comprises a backing sheet and a layer of electrically conductive material covering substantially the one whole of one face of said backing sheet.

8. A method of forming a perforated stencil using a layer of a material capable of perforation by spark erosion having attached to one face thereof a supporting flexible peelable backing material, said layer being in face to face relationship with an electrically conductive face removably attached to said layer along an edge portion of said layer, comprising the steps of peeling the flexible supporting backing material from the spark perforable layer, perforating said layer by generating electrical discharges from a stylus through said layer of material to said electrically conductive face and removing said electrically conductive face from said layer.

* * * * *